US009347186B2

(12) United States Patent
Frelich et al.

(10) Patent No.: US 9,347,186 B2
(45) Date of Patent: May 24, 2016

(54) AUTOMATIC MATERIAL PRE-FILL CONTROL PROCESS FOR PAVING MACHINE

(71) Applicant: CATERPILLAR PAVING PRODUCTS INC., Brooklyn Park, MN (US)

(72) Inventors: Toby Frelich, St. Michael, MN (US); Ricky Mings, Andover, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 14/444,077

(22) Filed: Jul. 28, 2014

(65) Prior Publication Data

US 2016/0024725 A1 Jan. 28, 2016

(51) Int. Cl.
*E01C 19/48* (2006.01)
*E01C 19/20* (2006.01)

(52) U.S. Cl.
CPC ..... *E01C 19/48* (2013.01); *E01C 19/20* (2013.01); *E01C 2019/2065* (2013.01)

(58) Field of Classification Search
CPC . E01C 2301/02; E01C 19/4873; E01C 19/00; E01C 19/006; E01C 19/48
See application file for complete search history.

(56) References Cited

U.S. PATENT DOCUMENTS 3,967,912 A * 7/1976 Parker ..... E01C 19/4873 404/108
4,823,366 A 4/1989 Williams
4,933,853 A * 6/1990 Musil ..... G01S 15/88 37/382
5,201,604 A * 4/1993 Ferguson ..... E01C 19/008 404/110
5,258,961 A * 11/1993 Sehr ..... E01C 19/006 367/96
5,430,651 A * 7/1995 Nielsen ..... E01C 19/006 172/4.5
5,452,966 A * 9/1995 Swisher, Jr. ..... E01C 19/48 404/108
5,529,434 A 6/1996 Swisher, Jr.
5,531,542 A 7/1996 Willis
5,533,829 A 7/1996 Campbell
5,575,583 A 11/1996 Grembowicz et al.
5,588,776 A * 12/1996 Swisher, Jr. ..... E01C 23/04 404/101
6,244,782 B1 * 6/2001 Bitelli ..... E01C 19/48 198/841
7,484,911 B2 * 2/2009 Frelich ..... E01C 19/48 222/71
8,070,385 B2 * 12/2011 Green ..... E01C 19/006 404/118
8,469,630 B2 6/2013 Olson et al.
8,573,829 B2 11/2013 Gordon
8,591,144 B1 11/2013 Bean et al.
9,004,811 B2 * 4/2015 Mings ..... G01S 15/88 404/118
2002/0110419 A1 * 8/2002 Batty ..... E01C 19/48 404/84.1
2006/0045620 A1 * 3/2006 Olson ..... E01C 19/48 404/84.1
2013/0195550 A1 8/2013 Bertz et al.
2014/0099165 A1 4/2014 Smieja

* cited by examiner

*Primary Examiner* — Abigail A Risic
(74) *Attorney, Agent, or Firm* — Miller, Matthias & Hull LLP

(57) ABSTRACT

A machine and method for pre-filling an auger chamber is disclosed. The machine may comprise a frame, a screed assembly, a conveyor, an auger disposed in the auger chamber, and a controller. The controller is configured to cause the transporting of material on the conveyor to the auger chamber, stop the conveyor if a fill period has expired, cause the auger to move a portion of the material toward an end of the auger, and stop the auger if either the auger run period has expired or the material disposed at the end of the auger has reached an auger material height threshold.

20 Claims, 7 Drawing Sheets

AUTOMATIC MATERIAL PRE-FILL CONTROL PROCESS FOR PAVING MACHINE

TECHNICAL FIELD

The present disclosure generally relates to automatic control processes in machines and, more particularly, relates to automatic material pre-fill control processes for use in paving machines, and the like.

BACKGROUND

Asphalt road paving machine(s) ("asphalt paver(s)") include a tractor with a hopper, a feed conveyor and an auger. The hopper is typically located at the front of the asphalt paver, and receives and holds asphalt paving material. The feed conveyor delivers the asphalt paving material to the spreader auger at the rear of the paver. The auger distributes the asphalt, laterally behind the tractor, to the road surface in front of a screed assembly.

Asphalt pavers also include the screed assembly, a heavy assembly drawn behind the asphalt paver by a pair of pivotally mounted tow arms. The screed assembly smoothes out and compresses the asphalt material that has been spread by the auger. The screed assembly may include a screed extender frame for adjusting a main screed width.

Road mat thickness is determined in part by asphalt material composition, machine specifics, as well as by the volume of the asphalt material pile placed in front of the screed. Asphalt material composition and screed specifics are typically constants with a specific machine and mix; however, the height of the material pile must be provided by the conveyor and auger before the asphalt paver starts and moves forward, and then as the asphalt paver continues to move forward. Material pile height should remain constant to pave an even surface. Sensors help determine the amount of material in front of the screed.

At the start of paving, the area around the auger (in front of the screed) typically is empty. In order to have a constant material mat height, as opposed to a sloped hill, bump or cavity, a sufficient level of asphalt material should be loaded into the area around the auger and be spread at that level the width of the desired paving section. Typically the conveyor and auger are run prior to movement of the asphalt paver to pre-fill the auger chamber of the asphalt paver. Because the asphalt paver is not moving, this process sometimes leads to undesirable effects such as asphalt segregation or asphalt being pulled underneath the machine by the conveyor. Movement of the machine during this initial time can lead to the uneven pavement.

U.S. Pat. No. 8,469,630 ("Olson et al.") issued Jun. 25, 2013 describes a sensor system for road construction equipment. The system includes a conveyor for transporting material to an auger. A feeder sensor associated with the conveyor communicates the height of the material on top of the conveyor such that a master controller can regulate the amount of flow of material to the conveyor. The disclosure does not address pre-filling of the auger chamber to ensure that the mat laid down by the paving machine is constant and even from the start of paving. A better design is needed.

SUMMARY OF THE DISCLOSURE

In accordance with one aspect of the disclosure, a machine is disclosed. The machine may comprise a tractor body frame having a plurality of sides, a hopper disposed on the tractor body frame; a screed assembly operably connected to the tractor body frame, a first conveyor disposed on the tractor body frame and configured to receive and transport material from the hopper, a first auger and a controller. The screed assembly and the tractor body frame may define an auger chamber. The first auger may be disposed in the auger chamber. The first auger may be disposed generally perpendicular to the first conveyor. The first auger may include a first auger first end disposed proximal to a first side of the tractor body frame and a first auger second end disposed proximal to the first conveyor. The controller may be configured to cause a transporting of material on the first conveyor to the auger chamber, stop the first conveyor if a first conveyor fill period has expired, cause the first auger to move at least a portion of the material received from the first conveyor away from the first conveyor and toward the first auger first end, and stop the first auger if either a first auger run period has expired or the material disposed at the first auger first end has reached a first auger material height threshold.

In accordance with another aspect of the disclosure, a method of pre-filling an auger chamber of a stationary machine is disclosed. The machine may include a tractor body frame, a first conveyor, a first auger, a screed assembly, and a controller. The screed assembly and the tractor body frame may define an auger chamber in which the first auger is disposed. The method may comprise transporting material on the first conveyor to the auger chamber, and stopping the first conveyor, by the controller, if a first conveyor fill period has expired. The method may further include causing, by the controller, the first auger to move at least a portion of the material received from the first conveyor away from the first conveyor and toward a first auger first end, and stopping the first auger, by the controller, if either a first auger run period has expired or the material disposed at the first auger first end has reached a first auger material height threshold. The method may further include, when the first auger material height threshold has been reached, causing, by the controller, the first conveyor to transport additional material to the auger chamber for the first conveyor fill period and then stopping the first conveyor. In an embodiment, stopping the first conveyor may further include stopping the first conveyor if a first conveyor fill height threshold has been reached.

In accordance with a further aspect of the disclosure, a machine is disclosed. The machine may comprise a tractor body frame having a plurality of sides, a hopper disposed on the tractor body frame; a screed assembly operably connected to the tractor body frame, a first conveyor disposed on the tractor body frame and configured to receive and transport material from the hopper, a first auger and a controller. The screed assembly and the tractor body frame may define an auger chamber. The first auger may be disposed in the auger chamber. The first auger may be disposed generally perpendicular to the first conveyor. The first auger may include a first auger first end disposed proximal to a first side of the tractor body frame and a first auger second end disposed proximal to the first conveyor. In response to activation input and when the machine is stationary, the controller may be configured to cause a transporting of material on the first conveyor to the auger chamber, stop the first conveyor if a first conveyor fill period has expired, cause the first auger to move at least a portion of the material received from the first conveyor away from the first conveyor and toward the first auger first end, stop the first auger if either a first auger run period has expired or the material disposed at the first auger first end has reached a first auger material height threshold, and, when the first auger material height threshold has been reached, cause the first conveyor to transport additional material to the auger chamber for the first conveyor fill period and then stop the first conveyor. The first conveyor fill period and the first auger run period may be about the same

DETAILED DESCRIPTION

Figure 1:
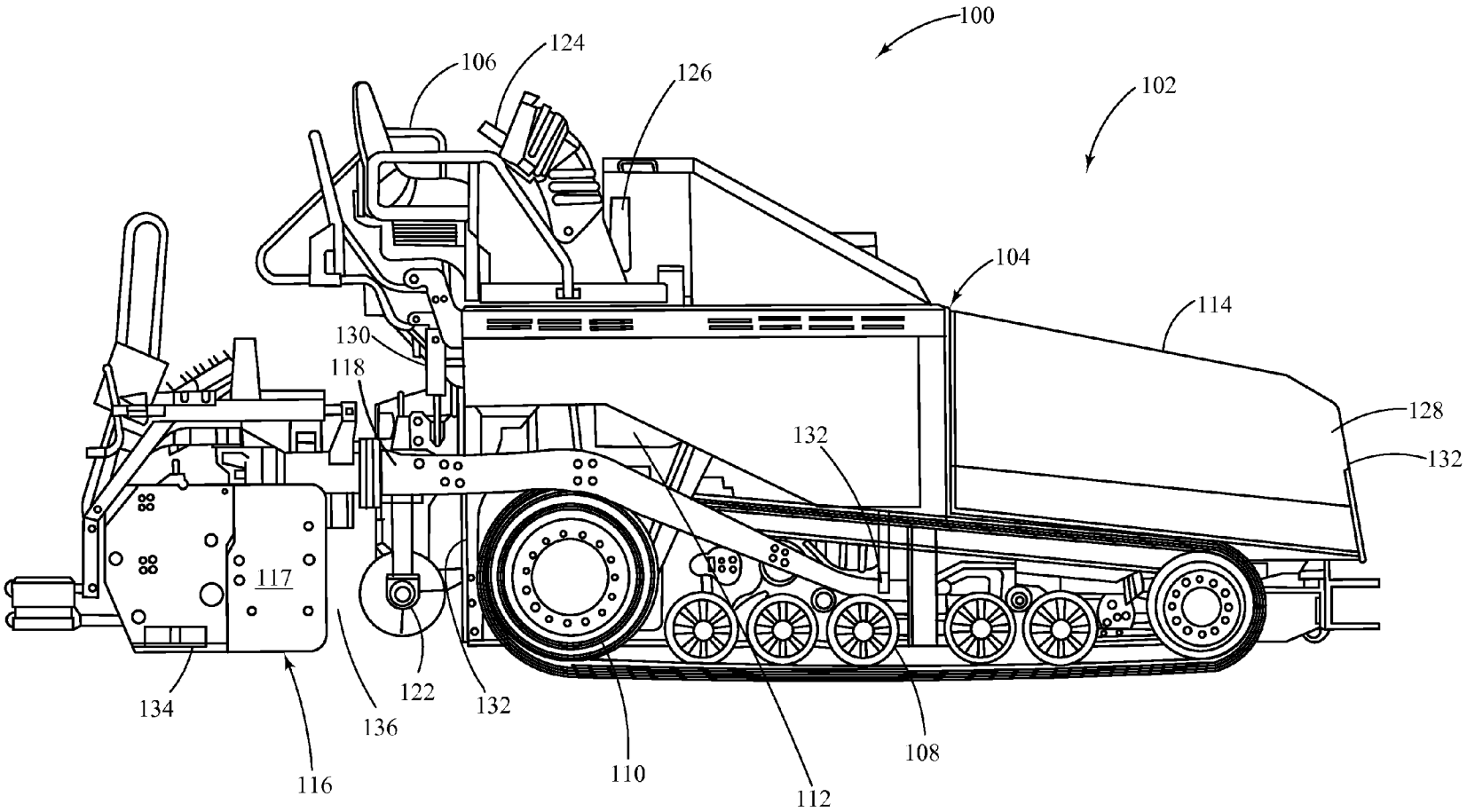
FIG. 1 is a side view of an exemplary machine.

FIG. 1 illustrates one example of a machine 100 that incorporates the features of the present disclosure. The exemplary machine 100 may be a vehicle such as an asphalt paver 102 or the like. The asphalt paver 102 may include a tractor body frame 104. Further, an operator station 106 may be mounted to the tractor body frame 104. In one embodiment, the operator station 106 may be mounted to the tractor body frame 104 proximal to an engine enclosure 108 and on the rear 130 of the tractor body frame 104. The asphalt paver 102 may be supported on the ground by a plurality of wheels or track assemblies 110. One of ordinary skill in the art will appreciate that the engine 112 may provide power to the track assemblies 110 and a final drive assembly (not shown), via mechanical or electric drive drain. While the following detailed description and drawings are made with reference to asphalt paver 102, the teachings of this disclosure may be employed on similar machines.

Figure 2:
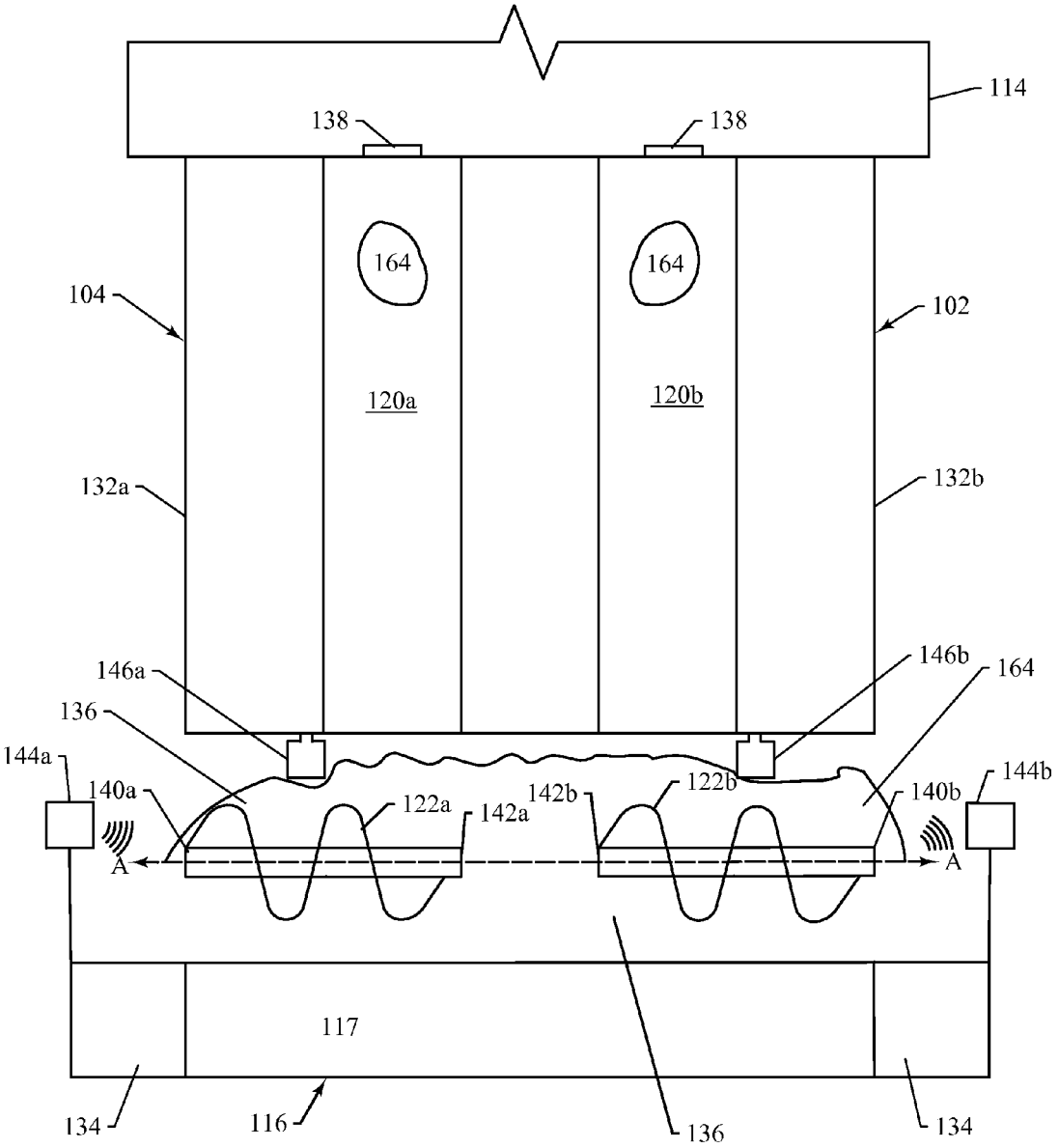
FIG. 2 is a schematic representation of a portion of the exemplary machine of FIG. 1.

Referring now to FIGS. 1-2, the asphalt paver may comprise a tractor body frame 104, a hopper 114 disposed on the tractor body frame 104, a screed assembly 116, tow arms 118, a first conveyor 120*a*, a second conveyor 120*b*, a first auger 122*a*, a second auger 122*b*, and a controller 126.

The tractor body frame 104 has a front 128, a rear 130 and includes a plurality of sides 132. The hopper 114 may be disposed on the front 128 of the tractor body frame 104 and is configured to receive and hold paving material. Flow gates 138 may be disposed in the hopper 114 adjacent to the conveyors 120*a*, 120*b*. Material from the hopper 114 may move through the flow gates 138 unto the conveyors 120*a*, 120*b*.

The screed assembly 116 may be operably connected to the tractor body frame 104 by a pair of pivotable tow arms 118. The screed assembly 116 includes a main screed 117. In some embodiments, the screed assembly 116 may also include a screed extender 134, as is known in the art. Such screed extender 134 may serve to extend the mat coverage of the main screed 117 on either or both sides of the main screed 117. In other embodiments, the main screed 117 may be extendible. The tow arms 118, one located on each side of asphalt paver 102, pull the screed assembly 116 when the asphalt paver moves. The screed assembly 116 and the tractor body frame 104 define an auger chamber 136. The auger chamber 136 is the area between the screed assembly 116 and (back) side 132*c* of the tractor body frame 104. In one embodiment, the auger chamber 136 is open on the sides and may be open at the top. In embodiments of the screed assembly 116, in which screed extender(s) 134 are used in conjunction with the main screed 117, or in which the main screed 117 is extended, the auger chamber 136 may extend the full length of the extended screed assembly 116. For example, in the scenario where screed extender(s) 134 are used in conjunction with the main screed 117, the length of the auger chamber 136 is the combined length of the screed extender(s) 134 plus the length of the main screed 117. In such a scenario, the auger chamber 136 may be longer than the (back) side 132*c* of the tractor body frame 104.

Each conveyor 120*a*, 120*b* is disposed on the tractor body frame 104. Each conveyor 120*a*, 120*b* may be a rotatable conveyor configured to received material 164 from the hopper 114 and transport the material 164 to the auger chamber 136. The material 164 may be received from the hopper 114 through flow gates 138 in the hopper 114. As each conveyor 120*a*, 120*b* rotates toward the auger chamber, the material 164 at the end of conveyor 120*a*, 120*b* (proximal to the auger chamber 136) falls off the conveyor 120*a*, 120*b* and into the auger chamber 136. In an embodiment, the conveyors 120*a*, 120*b* may be disposed in generally parallel orientation to each other.

Each auger 122*a*, 122*b* is disposed in front of the screed assembly 116 (in particular, the main screed 117) and in the auger chamber 136. Each auger 122*a*, 122*b* may be oriented generally perpendicular to the conveyors 120*a*, 120*b*. More specifically, a first auger 122*a* may be oriented generally perpendicular to a first conveyor 120*a*, and a second auger 122*b* may be oriented generally perpendicular to a second conveyor 120*b*. The first auger 122*a* may include a (first auger) first end 140*a* disposed proximal to a side 132*a* of the tractor body frame 104 and a (first auger) second end 142*a* disposed proximal to the second auger 122*b* and the first conveyor 120*a* from which the first auger 122*a* receives material 164. The second auger 122*b* may include a (second auger) first end 140*b* disposed proximal to a side 132*b* of the tractor body frame 104 and a (second auger) second end 142*b* disposed proximal to the second end 142*a* of the first auger 122*a* and to the second conveyor 120*b* from which the second auger 122*b* receives material 164. In this arrangement, the first and second sides 132*a*, 132*b* of the tractor body frame 104 are opposite to each other. Each of the augers 122*a*, 122*b* may be configured to move the material 164 in the auger chamber 136 in a direction generally perpendicular to the conveyors 120*a*, 120*b*. In one embodiment, the first and second augers 122*a*, 122*b* may move material 164 in opposite directions. In some embodiments, the first auger 122*a* and the second auger 122*b* may be extended, as is known in the art. When the first auger 122*a* is extended, the first end 140*a* (of the collective extended first auger 122*a*) may be disposed proximal to a side 132*a* of the tractor body frame 104, and the second end 142*a* (of the collective extended first auger 122*a*) may be disposed proximal to the second auger 122*b* and the first conveyor 120*a*. Similarly, when the second auger 122*b* is extended, the first end 140*b* (of the collective extended second auger 122*b*) may be disposed proximal to a side 132*b* of the tractor body frame 104, and the second end 142*b* (of the collective extended second auger 122*b*) may be disposed proximal to the second end 142*a* of the first auger 122*a* and to the second conveyor 120*b*.

The asphalt paver 102 may further include a plurality of auger sensors 144. The plurality of auger sensors 144 may be sonic or paddle sensors, or any other appropriate sensor. In one embodiment, a first auger sensor 144*a* may be disposed on an end of the main screed 117 or on an end of the screed extender 134. The first auger sensor 144*a* may be positioned to measure a height of the material 164 (the "material height") disposed proximal to the first end 140*a* of the first auger 122*a* and disposed in front of the main screed 117 or screed extender 134. The material height is the measured or estimated vertical height of the material from the point of measurement on a top surface of the material 164 to the ground. In the embodiment of FIG. 2, the first auger sensor 144*a* is positioned to measure a height of the material 164 in front of the screed extender 134. More specifically, the first auger sensor 144*a* may be disposed to measure the material height of material 164 disposed about 33 cm to about 59 cm outward from the first end 140*a* of the auger 122*a*. The term "outward" meaning in a direction away from the augers 122*a*, 122*b*. For example, in one embodiment, the material 164 may be disposed about 33 cm to about 59 cm outward along the axis centerline A of the first auger 122*a*. In another embodiment, the first auger sensor 144*a* may be positioned to measure a material height of material 164 disposed in front of the main screed 117 (or screed extender 134) about 46 cm outward from the first end 140*a* of the auger 122*a*. In one embodiment, the material 164 measured may be disposed about 46 cm outward along the axis centerline A of the first auger 122*a*.

A second auger sensor 144*b* may be disposed on an end of the main screed 117 or on an end of the screed extender 134. The second auger sensor 144*b* may be positioned to measure a material height of material 164 disposed proximal to the first end 140*b* of the second auger 122*b* and in front of the main screed 117 or screed extender 134. In the embodiment of FIG. 2, the second auger sensor 144*b* is positioned to measure the material height of material 164 in front of the screed extender 134. In one embodiment, the second auger sensor 144*b* may be disposed to measure the material height of material 164 disposed about 33 cm to about 59 cm outward from the first end 140*b* of the second auger 122*b*. For example, about 33 cm to about 59 cm outward along the axis centerline A of the second auger 122*b*. In another embodiment, the first auger sensor 144*a* may be positioned to measure a material height of material 164 in front of the main screed 117 (or screed extender 134) about 46 cm outward from the first end 140*b* of the auger 122*a*. In one embodiment, the material 164 measured may be disposed about 46 cm outward along the axis centerline A of the second auger 122*b*.

In some embodiments, the asphalt paver 102 may further include a plurality of conveyor sensors 146. The plurality of conveyor sensors 146 may be paddle sensors, sonic sensors or any other appropriate sensor. In one embodiment, a first conveyor sensor 146*a* may be disposed on the tractor body frame 104. In an embodiment, the first conveyor sensor 146*a* may be disposed on a (back) side 132*c* of the tractor body frame 104, inside the auger chamber 136 and adjacent or proximal to the end of the conveyor 120*a*. The first conveyor sensor 146*a* may be positioned to measure a height of the material 164 disposed in front of the main screed 117 and inside the auger chamber 136 (the "fill height"). The fill height is the measured or estimated vertical height of the material in the auger chamber 136 from a top surface at the point of measurement to the ground. In the embodiment of FIG. 2, the first conveyor sensor 146*a* is positioned proximal to the center (lengthwise) of the first auger 122*a*.

A second conveyor sensor 146*b* may also be disposed on the tractor body frame 104. In an embodiment, the second conveyor sensor 146*b* may be disposed on a (back) side 132*c* of the tractor body frame 104, inside the auger chamber 136 and opposite to the end of the second conveyor 120*b*. Like, the first conveyor sensor 146*a*, the second conveyor sensor 146*b* may be positioned to measure a fill height. In the embodiment of FIG. 2, the second conveyor sensor 146*b* is positioned proximal to the center (lengthwise) of the second auger 122*b*.

The controller 126 may include a processor 148 and a memory component 150. The processor 148 may be a microprocessor or other processor as known in the art. The processor 148 may execute instructions and generate control signals for processing an input signal indicative of the material height or fill height, elapsed auger run period, elapsed conveyor fill period, and for starting and stopping the conveyors 120*a*, 120*b*, and the augers 122*a*, 122*b* of the asphalt paver 102. Such instructions that are capable of being executed by a computer may be read into or embodied on a computer readable medium, such as the memory component 150 or provided external to the processor 148. In alternative embodiments, hard wired circuitry may be used in place of, or in combination with, software instructions to implement a control method.

The term "computer readable medium" as used herein refers to any non-transitory medium or combination of media that participates in providing instructions to the processor 148 for execution. Such a medium may comprise all computer readable media except for a transitory, propagating signal. Common forms of computer-readable media include, for example, a floppy disk, a flexible disk, hard disk, magnetic tape, or any other magnetic medium, a CD-ROM, any other optical medium, or any other medium from which a computer processor 148 can read.

The controller 126 is not limited to one processor 148 and memory component 150. The controller 126 may be several processors 148 and memory components 150.

Figure 3:
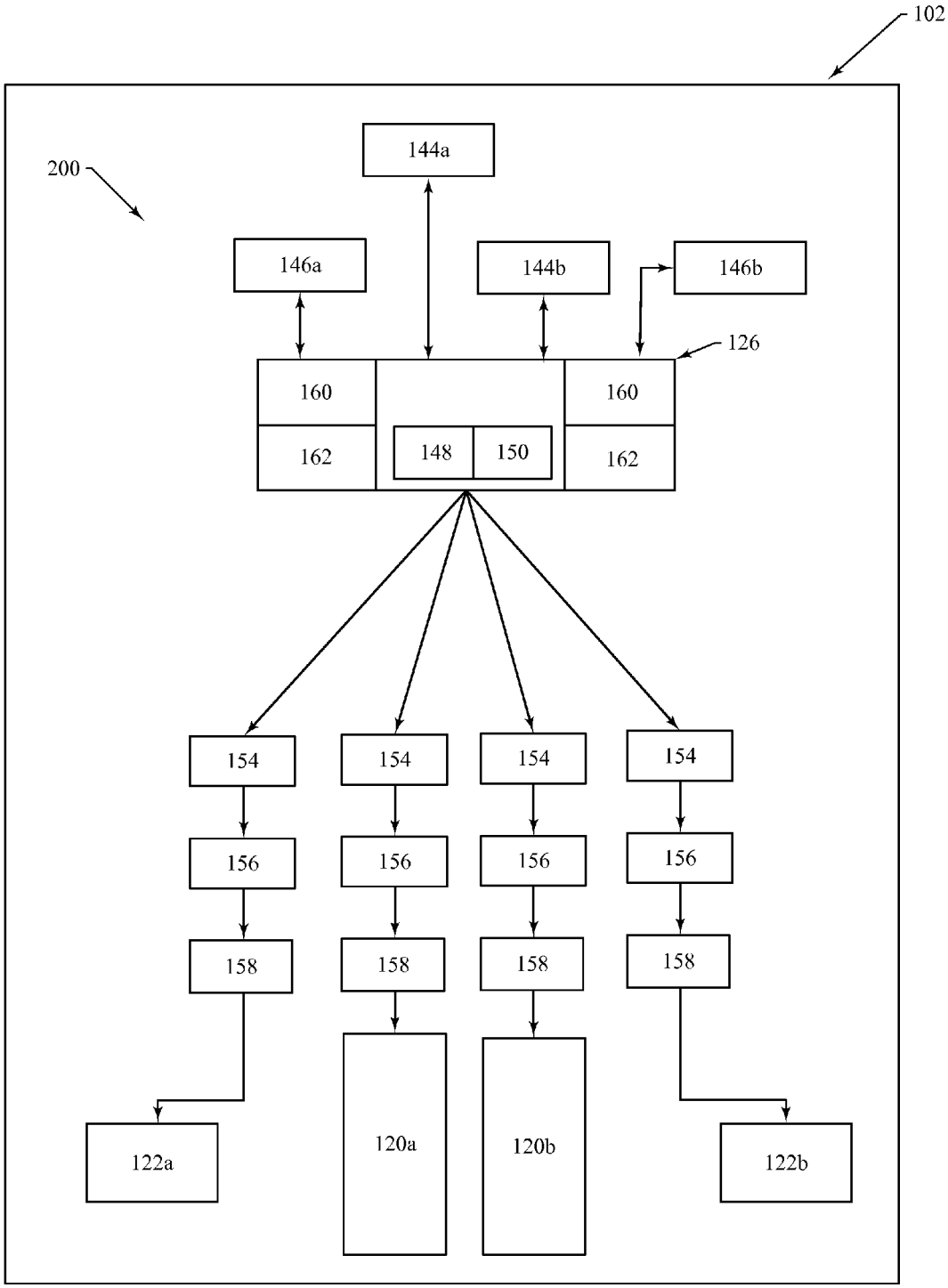
FIG. 3 is a schematic representation of an exemplary system incorporated in the exemplary machine of FIG. 1.

FIG. 3 illustrates a schematic of an exemplary system 200 for the asphalt paver 102. As can be seen in FIG. 3, the controller 126 may be operably connected to the auger sensors 144*a*, 144*b*, the conveyor sensors 146*a*, 146*b*, and the conveyors 120*a*, 120*b* and the augers 122*a*, 122*b* via the drivers 154, pumps 156 and motors 158. In the embodiment of FIG. 3, each auger is driven by a separate driver 154, pump 156 and motor 158. Similarly, each conveyor is driven by a separate driver 154, pump 156 and motor 158. The conveyor timers 160 and auger timers 162 may be part of the controller 126 or may be operably connected to the controller 126 and the timing information may be transmitted to the controller 126.

Figure 4:
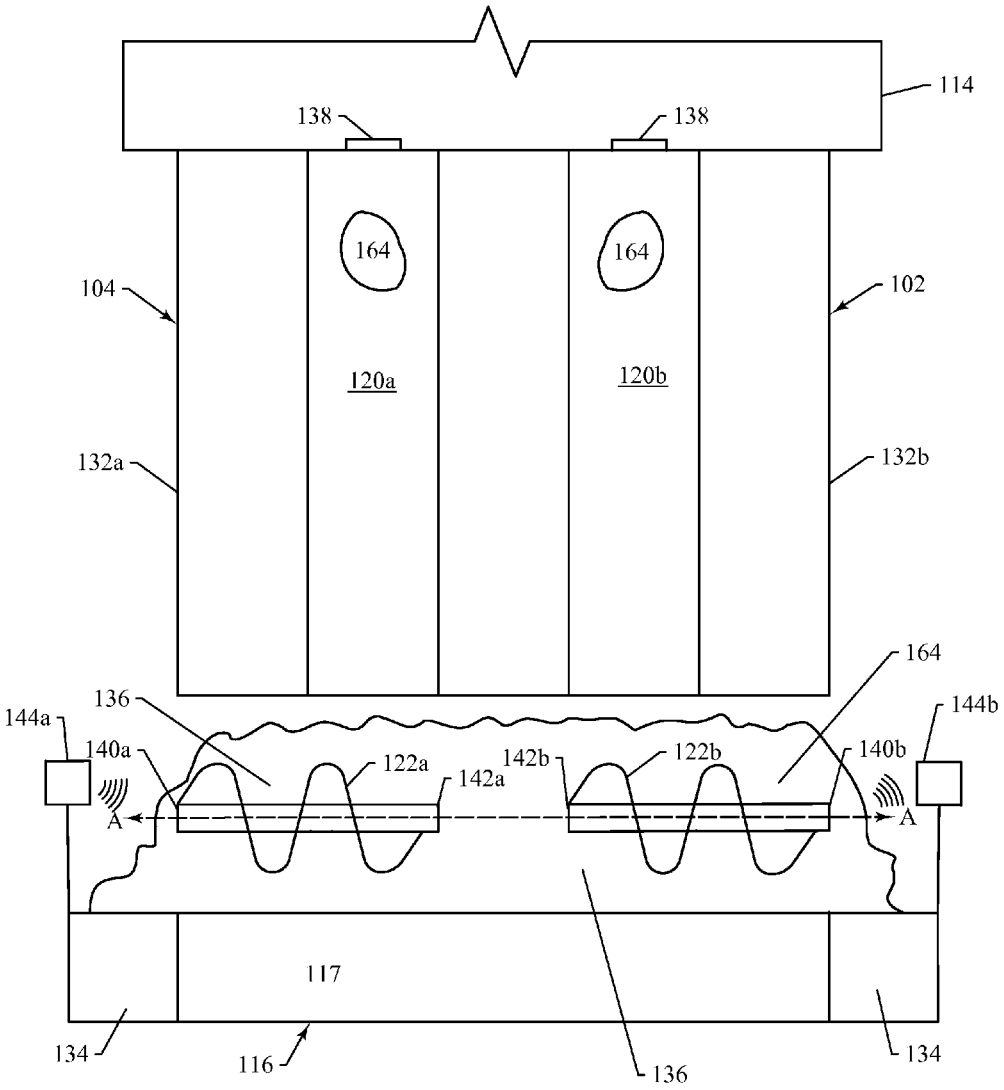
FIG. 4 is a schematic representation of a portion of an alternative exemplary machine that does not include conveyor sensors for measuring fill height.
Figure 5:
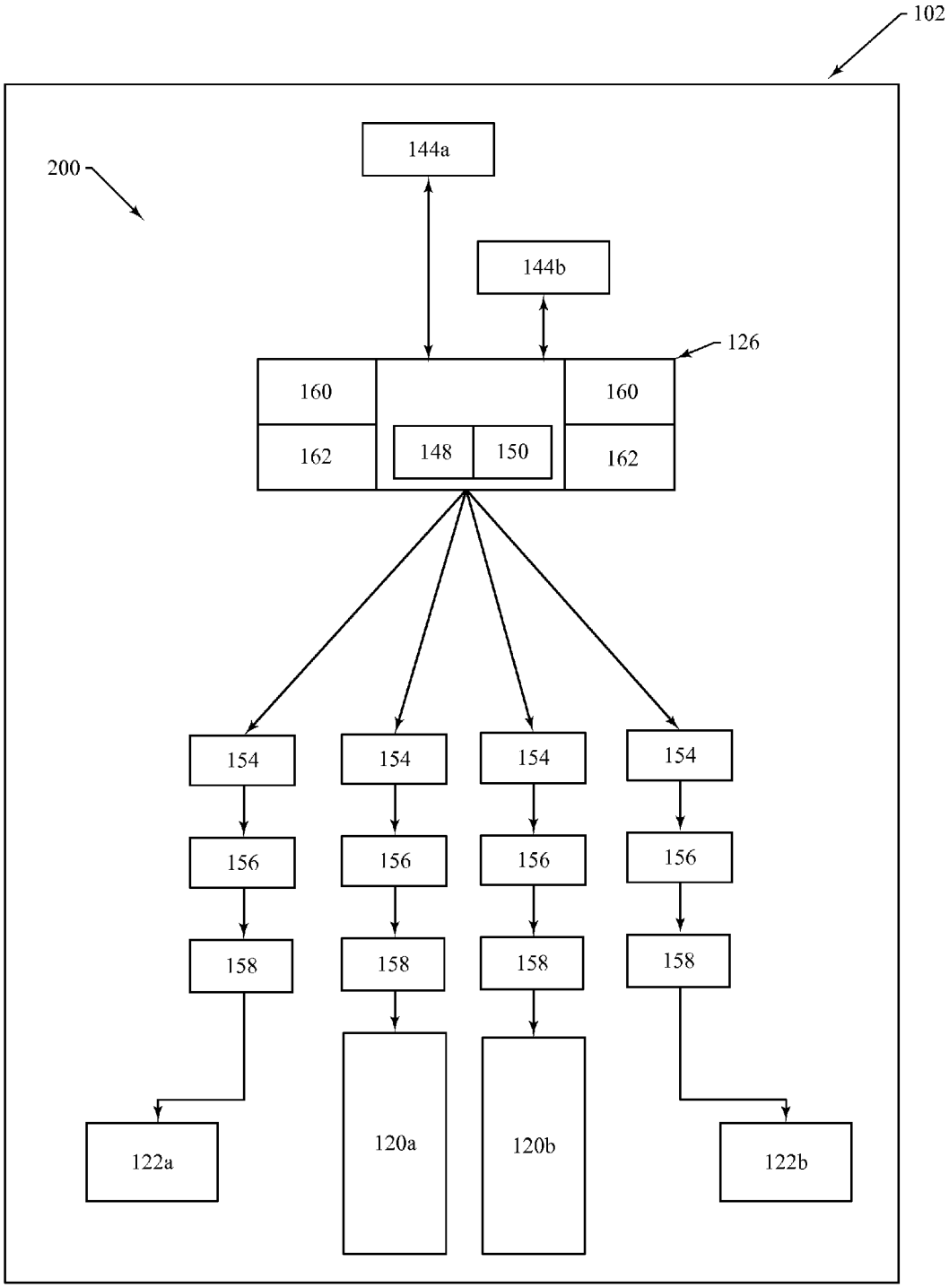
FIG. 5 is a schematic representation of an alternative exemplary system that does not include conveyor sensors for measuring fill height.

FIGS. 4-5 illustrate an embodiment in which the asphalt paver 102 does not include the conveyor sensors 146. FIGS. 4-5 are the same as FIGS. 2-3, except that the conveyor sensors 146 are removed.

Also disclosed is a method of pre-filling an auger chamber 136 of a stationary machine 100. The machine 100 including a tractor body frame 104, a first conveyor 120*a*, a first auger 122*a*, a screed assembly 116, and a controller 126. The screed assembly 116 and the tractor body frame 104 may define an auger chamber 136 in which the first auger 122*a* is disposed. The method may comprise transporting material 164 on the first conveyor 120*a* to the auger chamber 136, and stopping the first conveyor 120*a*, by the controller 126, if a first conveyor fill period has expired. The method may further include causing, by the controller 126, the first auger 122*a* to move at least a portion of the material 164 received from the first conveyor 120*a* away from the first conveyor 120*a* and toward a first auger first end 140*a*, and stopping the first auger 122*a*, by the controller 126, if either a first auger run period has expired or the material 164 disposed at the first auger first end 140*a* has reached a first auger material height threshold. The method may further include, when the first auger material height threshold has been reached, causing, by the controller 126, the first conveyor 120*a* to transport additional material 164 to the auger chamber 136 for the first conveyor fill period and then stopping the first conveyor 120*a*. In an embodiment, stopping the first conveyor 120*a* may further include stopping the first conveyor 120*a* if a first conveyor fill height threshold has been reached.

In an embodiment, the machine 100 may further include a hopper 114 disposed on the tractor body frame 104, a second conveyor 120*b* disposed on the tractor body frame 104 and configured to receive and transport material 164 from the hopper 114, and a second auger 122*b* disposed in the auger chamber 136. The second auger 122*b* may be disposed generally perpendicular to the second conveyor 120*b*. The second auger 122*b* may include a second auger first end 140*b* disposed proximal to a second side 132*b* of the tractor body frame 104 and a second auger second end 142*b* disposed proximal to the second conveyor 120*b* and to the first auger 122*b*. The first side 132*a* of the tractor body frame 104 may be opposite to the second side 132*b* of the tractor body frame 104. With the aforementioned, the method may further include causing, by the controller 126, the transporting of material 164 on the second conveyor 120*b* to the auger chamber 136, and stopping the second conveyor 120*b*, by the controller 126, if a second conveyor fill period has expired. The method may further include causing, by the controller 126, the second auger 122*b* to move at least a portion of the material 164 received from the second conveyor 120*b* away from the second conveyor 120*b* and toward the second auger first end 140*b*, and stopping the second auger 122*b*, by the controller 126, if either a second auger run period has expired or the material 164 disposed at the end of the second auger 122*b* has reached a second auger material height threshold. The method may further include, when the second auger material height threshold has been reached, causing, by the controller 126, the second conveyor 120*b* to transport additional material 164 to the auger chamber 136 for the second conveyor fill period and then stopping the second conveyor 120*b*. In a refinement, stopping the second conveyor 120*b* may further include stopping the second conveyor 120*b* if a second conveyor fill height threshold has been reached. Operation, by the controller 126, of the first conveyor 120*a* and first auger 122*a* may be independent of operation of the second conveyor 120*b* and second auger 122*b*.

INDUSTRIAL APPLICABILITY

Figure 6:
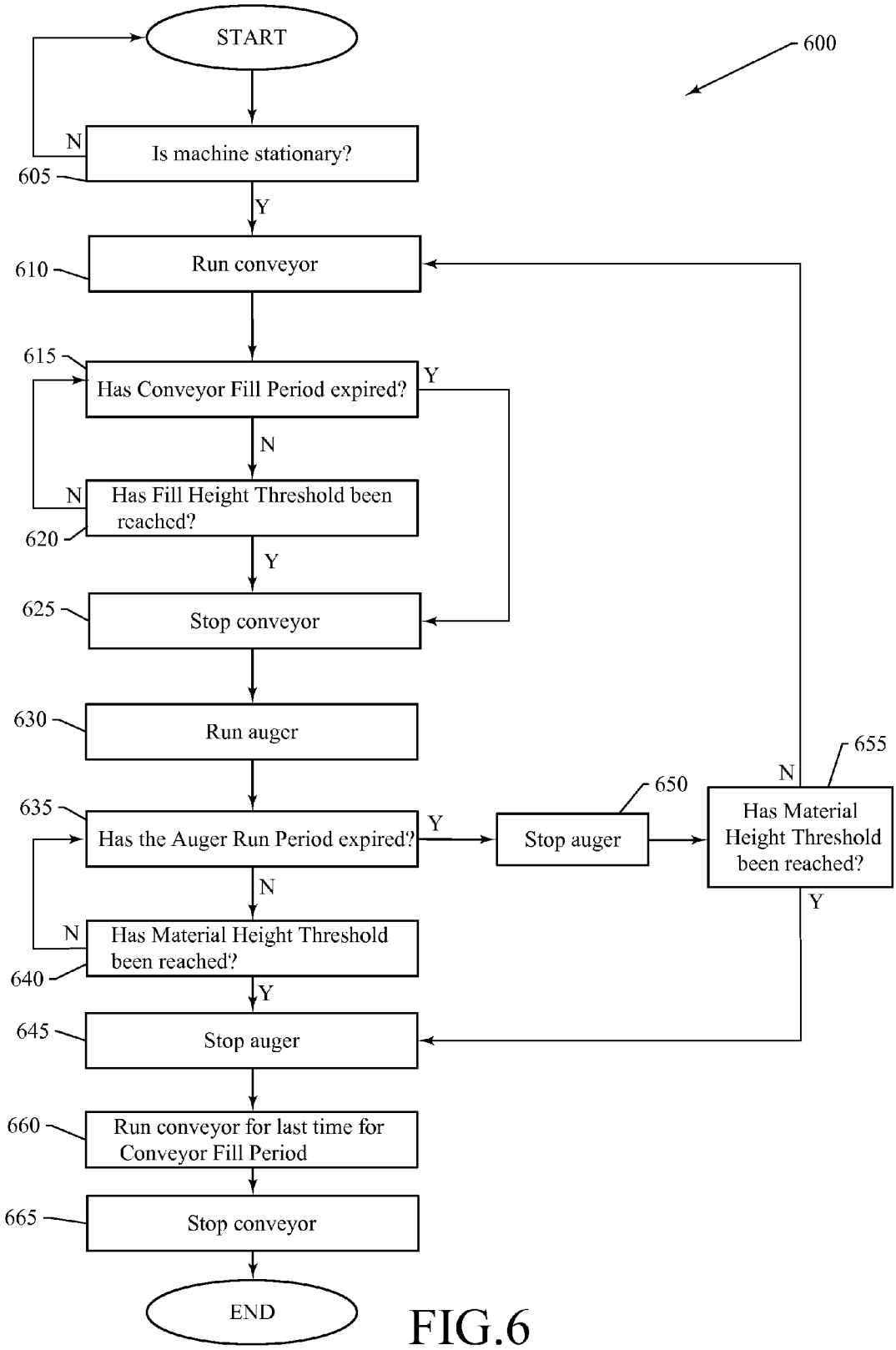
FIG. 6 is an exemplary process for pre-filling an auger chamber.

FIG. 6 illustrates an exemplary process 600 for pre-filling an auger chamber 136 of a machine 100 or asphalt paver 102. This process 600 may be triggered for the machine 100 or asphalt paver 102 by activation, for example by an operator, of an automatic pre-fill button, switch, lever, knob or the like. The process is the same for both the left and right conveyor and auger sets 120*a*, 122*a* and 120*b*, 122*b*. While for simplicity sake and clarity, the process is only described for one set, the left conveyor 120*a* and auger 122*a* set, it is equally applicable for the right conveyor 120*b* and auger set 122*b*. The left and right conveyors 120*a*, 120*b* operate independently of each other as do the left and right augers 122*a*, 122*b*. In some embodiments, the process 600 may only run (or continue to run) when the automatic pre-fill button, switch, lever, knob, or the like, is in an active state.

After the controller 126 receives data indicative of an activated automatic pre-fill button, switch, lever, knob or the like, ("activation input") the controller 126, in block 605, checks whether the machine 100 is stationary. If the machine 100 is stationary, the process proceeds to block 610.

The process further includes, in block 610, the controller 126 causing the conveyor 120*a* to start running. The conveyor 120*a*, when running, transports material 164 disposed on the conveyor 120*a* to the auger chamber 136.

In block 615, the controller 126 checks whether the conveyor fill period has expired. The conveyor fill period is a time period that the conveyor operates before being shut off by the controller 126. In one exemplary embodiment, the conveyor fill period may be about five (5) seconds. In another exemplary embodiment, the conveyor fill period may be between about three (3) seconds to about seven (7) seconds. There may be a plurality of conveyor fill periods during the pre-filling of the auger chamber 136. For example, in one embodiment, the conveyor may have three conveyor fill periods during a given pre-fill. Each conveyor fill period will be the same length of time, unless terminated earlier by the controller 126. If the conveyor fill period has not expired, the process proceeds to block 620. Otherwise the process proceeds to block 625.

In block 620, the controller 126 checks whether the fill height threshold has been reached. The fill height threshold is a threshold value for the fill height as measured by the conveyor sensor 146. If the fill height threshold is reached, the process proceeds to block 625. Otherwise the process returns to block 615.

The process further includes, in block 625, the controller 126 stopping the conveyor 120*a* and then proceeding to block 630.

The process further includes, in block 630, the controller 126 running the auger 122*a*. When the auger 122*a* is run, at least a portion of the material 164 received from the conveyor 120*a* is moved in the auger chamber 136 away from the conveyor 120*a* and toward the first end 140*a* of the auger 122*a*.

In block 635, the controller 126 checks whether the auger run period has expired. The auger run period is a time period that the auger 122*a* operates before being shut off by the controller 126. In one exemplary embodiment, the auger run period may be about five (5) seconds. In another exemplary embodiment, the auger run period may be between about three (3) seconds and about seven (7) seconds. There may be a plurality of auger run periods during the pre-filling of the auger chamber 136. For example, in one embodiment, the conveyor may have two auger run periods during a given pre-fill. Each auger run period will be the same length of time, unless terminated earlier by the controller 126. If the auger run period has not expired, the process proceeds to block 640. Otherwise the process proceeds to block 650.

In block 640, the controller 126 checks whether the material height threshold has been reached. The material height threshold is a threshold value for the material height as measured by the auger sensor 144. If the material height threshold is reached, the process proceeds to block 645. Otherwise the process returns to block 635.

When the process proceeds to block 650 (from block 635), the controller 126 stops the auger 122*a*. The process then proceeds to block 655.

In block 655, the controller 126 checks whether the material height threshold has been reached. If the material height threshold is reached, the process proceeds to block 645. Otherwise the process returns to block 610.

The process further includes, in block 645, the controller 126 stopping the auger 122*a* and then proceeding to block 660.

In block 660 the process further includes, the controller 126 causing the conveyor 120*a* to start and run one last time for the conveyor fill period. The process then proceeds to block 665.

The process further includes, in block 665, the controller 126 stopping the conveyor 120*a*. The auger chamber 136 is now pre-filled and ready for the asphalt paver to start the paving operation.

Figure 7:
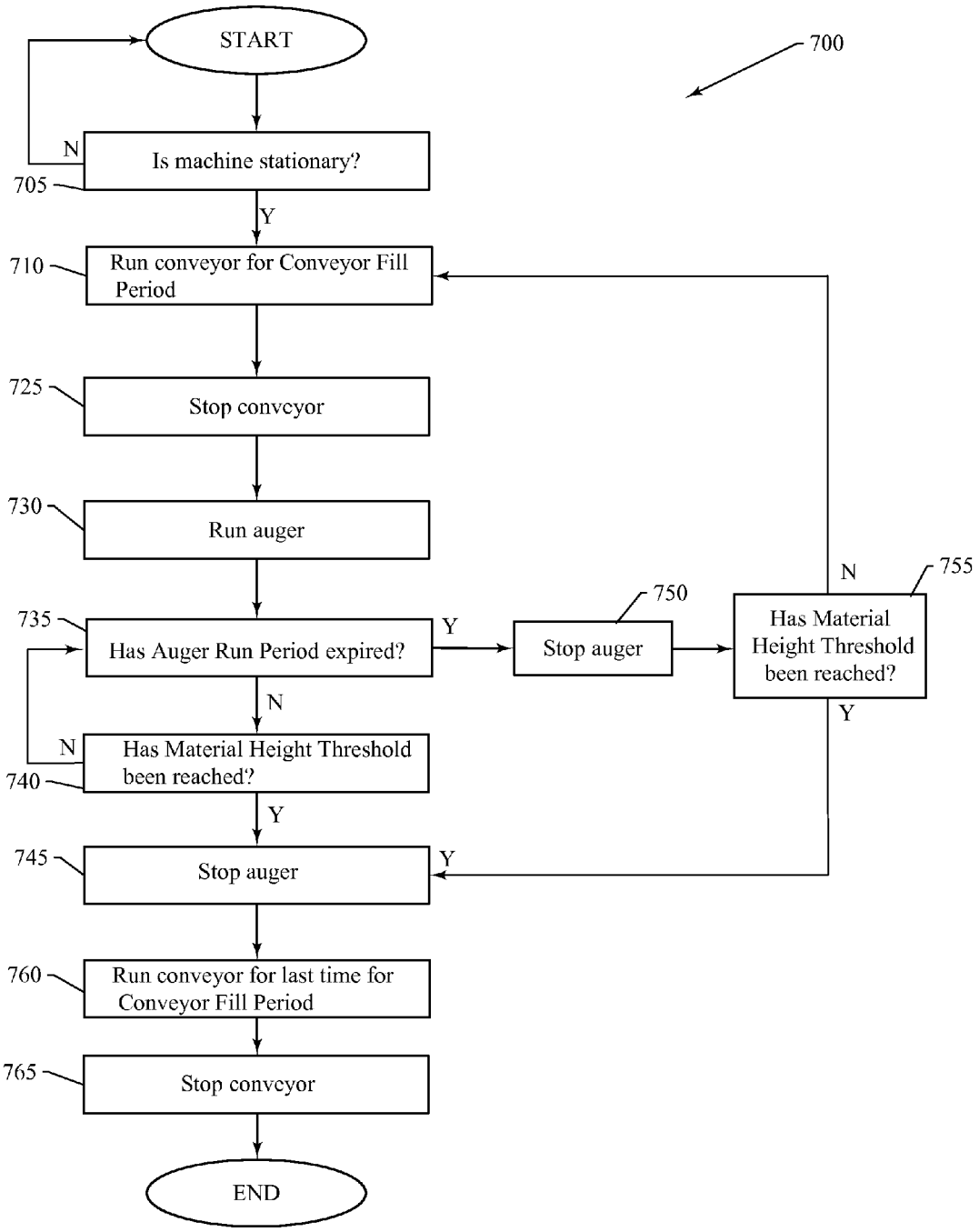
FIG. 7 is an alternative exemplary process for pre-filling an auger chamber.

FIG. 7 illustrates an alternative exemplary process 700 for pre-filling an auger chamber 136 of a machine 100 or asphalt paver 102 which does not utilize conveyor sensors 146. This process 700 may be triggered for the machine 100 or asphalt paver 102 by activation, for example by an operator, of an automatic pre-fill button, switch, lever, knob or the like. The process is the same for both the left and right conveyor and auger sets 120*a*, 122*a* and 120*b*, 122*b*. While for simplicity sake and clarity, the process is only described for one set, the left conveyor 120*a* and auger 122*a* set, it is equally applicable for the right conveyor and auger set 120*b*, 122*b*. The left and right conveyors 120*a*, 120*b* operate independently of each other as do the left and right augers 122*a*, 122*b*. In some embodiments, the process 700 may only run (or continue to run) when the automatic pre-fill button, switch, lever, knob, or the like, is in an active state.

After the controller 126 receives data indicative of an activated automatic pre-fill button, switch, lever, knob or the like (activation input), the controller 126, in block 705, checks whether the machine 100 is stationary. If the machine 100 is stationary, the process proceeds to block 710.

The process further includes, in block 710, the controller 126 causing the conveyor 120*a* to start and run for a conveyor fill period. In one exemplary embodiment, the conveyor fill period may be about five (5) seconds. In another exemplary embodiment, the conveyor fill period may be between about three (3) seconds to about seven (7) seconds. The conveyor 120*a*, when running, transports material disposed on the conveyor 120*a* to the auger chamber 136.

The process further includes in block 725, the controller 126 stopping the conveyor 120*a* and then proceeding to block 730.

The process further includes, in block 730, the controller 126 running the auger 122*a*. When the auger 122*a* is run, at least a portion of the material 164 received from the conveyor 120*a* is moved in the auger chamber 136 (by the auger 122*a*) away from the conveyor 120*a* and toward the first end 140*a* of the auger 122*a*.

In block 735, the controller 126 checks whether the auger run period has expired. In one exemplary embodiment, the auger run period may be about five (5) seconds. In another exemplary embodiment, the auger run period may be between about three (3) seconds and about seven (7) seconds. If the auger run period has not expired, the process proceeds to block 740. Otherwise the process proceeds to block 750.

In block 740, the controller 126 checks whether the material height threshold has been reached. If the material height threshold is reached, the process proceeds to block 745. Otherwise the process returns to block 735.

When the process proceeds to block 750 (from block 735), the controller 126 stops the auger 122*a*. The process then proceeds to block 755.

In block 755, the controller 126 checks whether the material height threshold has been reached. If the material height threshold is reached, the process proceeds to block 745. Otherwise the process returns to block 710.

The process further includes, in block 745, the controller 126 stopping the auger 122*a* and then proceeding to block 760.

In block 760 the process further includes, the controller 126 causing the conveyor 120*a* to start and run one last time for the conveyor fill period. The process then proceeds to block 765.

The process further includes, in block 765, the controller 126 stopping the conveyor 120*a*. The auger chamber 136 is now pre-filled and ready for the asphalt paver 102 to start the paving operation.

The features disclosed herein may be particularly beneficial to asphalt pavers 102. Use of the features enables appropriate pre-fill of the auger chamber 136 so that the asphalt mat laid down by the asphalt paver 102 has an even surface from start to finish and does not have bumps, cavities or hills at the start of the paved mat. The features further prevent unnecessary material segregation that can occur when the auger 122 is run before there is an appropriate amount of material 164 in the auger chamber 136 or, alternatively, material 164 being pulled underneath the asphalt paver 102 by the underside of the running conveyor 120 before the material 164 can be appropriately spread by the auger 122.

What is claimed is:

1. A machine comprising:

a tractor body frame having a plurality of sides;

a hopper disposed on the tractor body frame;

a screed assembly operably connected to the tractor body frame, the screed assembly and the tractor body frame defining an auger chamber;

a first conveyor disposed on the tractor body frame and configured to receive and transport material from the hopper;

a first auger disposed in the auger chamber, the first auger disposed generally perpendicular to the first conveyor, the first auger including a first auger first end disposed proximal to a first side of the tractor body frame and a first auger second end disposed proximal to the first conveyor; and a controller configured to:

cause a transporting of material on the first conveyor to the auger chamber;

stop the first conveyor if a first conveyor fill period has expired;

cause the first auger to move at least a portion of the material received from the first conveyor away from the first conveyor and toward the first auger first end; and stop the first auger if either a first auger run period has expired or the material disposed at the first auger first end has reached a first auger material height threshold.

2. The machine of claim 1, further including a first auger sensor positioned to measure a height of the material disposed proximal to the first auger first end.

3. The machine of claim 1, in which the controller is further configured to stop the first conveyor if a first conveyor fill height threshold has been reached.

4. The machine of claim 1, further including a first conveyor sensor positioned to measure a first conveyor fill height of the material disposed in the auger chamber proximal to the first auger.

5. The machine of claim 1, further including:

a second conveyor disposed on the tractor body frame and configured to receive and transport material from the hopper;

a second auger disposed in the auger chamber, the second auger disposed generally perpendicular to the second conveyor, the second auger including a second auger first end disposed proximal to a second side of the tractor body frame and a second auger second end disposed proximal to the second conveyor and to the first auger, the first side of the tractor body frame opposite to the second side of the tractor body frame; and in which the controller is further configured to:

cause the transporting of material on the second conveyor to the auger chamber;

stop the second conveyor if a second conveyor fill period has expired;

cause the second auger to move at least a portion of the material received from the second conveyor away from the second conveyor and toward the second auger first end;

stop the second auger if either a second auger run period has expired or the material disposed at the end of the second auger has reached a second auger material height threshold; and when the second auger material height threshold has been reached, cause the second conveyor to transport additional material to the auger chamber for the second conveyor fill period and then stop the second conveyor.

6. The machine of claim 5, in which the controller is further configured to stop the second conveyor if a second conveyor fill height threshold has been reached.

7. The machine of claim 5, wherein operation, by the controller, of the first conveyor and the first auger is independent of operation of the second conveyor and the second auger.

8. The machine of claim 1, wherein the first and second augers are configured to move material in opposite directions.

9. A method of pre-filling an auger chamber of a stationary machine, the machine including a tractor body frame, a first conveyor, a first auger, a screed assembly and a controller, the screed assembly and the tractor body frame defining the auger chamber, the auger disposed in the auger chamber, the method comprising:

transporting material on the first conveyor to the auger chamber;

stopping the first conveyor, by the controller, if a first conveyor fill period has expired;

causing, by the controller, the first auger to move at least a portion of the material received from the first conveyor away from the first conveyor and toward a first auger first end;

stopping the first auger, by the controller, if either a first auger run period has expired or the material disposed adjacent to the first auger first end has reached a first auger material height threshold; and when the first auger material height threshold has been reached, causing, by the controller, the first conveyor to transport additional material to the auger chamber for the first conveyor fill period and then stopping the first conveyor.

10. The method of claim 9, in which the machine further includes a first auger sensor positioned to measure a first auger material height of the material disposed proximal to the first end of the first auger.

11. The method of claim 9, in which stopping the first conveyor further includes stopping the first conveyor if a first conveyor fill height threshold has been reached.

12. The method of claim 10, in which the machine further includes a hopper disposed on the tractor body frame, a second conveyor disposed on the tractor body frame and configured to receive and transport material from the hopper, and a second auger disposed in the auger chamber, the second auger disposed generally perpendicular to the second conveyor, the second auger including a second auger first end disposed proximal to a second side of the tractor body frame and a second auger second end disposed proximal to the second conveyor and to the first auger, the first side of the tractor body frame opposite to the second side of the tractor body frame, the method further including:

causing, by the controller, the transporting of material on the second conveyor to the auger chamber;

stopping the second conveyor, by the controller, if a second conveyor fill period has expired;

causing, by the controller, the second auger to move at least a portion of the material received from the second conveyor away from the second conveyor and toward the second auger first end;

stopping the second auger, by the controller, if either a second auger run period has expired or the material disposed at the end of the second auger has reached a second auger material height threshold; and when the second auger material height threshold has been reached, causing, by the controller, the second conveyor to transport additional material to the auger chamber for the second conveyor fill period and then stopping the second conveyor.

13. The method of claim 12, in which stopping the second conveyor further includes stopping the second conveyor if a second conveyor fill height threshold has been reached.

14. The method of claim 12, wherein operation, by the controller, of the first conveyor and the first auger is independent of operation of the second conveyor and the second auger.

15. The method of claim 12, in which the machine further includes a first conveyor sensor positioned to measure a first conveyor fill height of the material disposed in the auger chamber proximal to the first auger.

16. A machine comprising:

a tractor body frame having a plurality of sides, a hopper disposed on the tractor body frame;

a screed assembly operably connected to the tractor body frame, the screed assembly and the tractor body frame defining an auger chamber;

a first conveyor disposed on the tractor body frame and configured to receive and transport material from the hopper;

a first auger disposed in the auger chamber, the first auger including a first auger first end disposed proximal to a first side of the tractor body frame and a first auger second end disposed proximal to the first conveyor; and a controller, in response to activation input and when the machine is stationary, the controller configured to:

cause a transporting of material on the first conveyor to the auger chamber;

stop the first conveyor if a first conveyor fill period has expired;

cause the first auger to move at least a portion of the material received from the first conveyor away from the first conveyor and toward the first auger first end;

stop the first auger if either a first auger run period has expired or the material disposed at the first auger first end has reached a first auger material height threshold; and when the first auger material height threshold has been reached, cause the first conveyor to transport additional material to the auger chamber for the first conveyor fill period and then stop the first conveyor, wherein the first conveyor fill period and the first auger run period are about the same.

17. The machine of claim 16, in which the controller is further configured to stop the first conveyor if a first conveyor fill height threshold has been reached.

18. The machine of claim 16, further including:

a second conveyor disposed on the tractor body frame and configured to receive and transport material from the hopper;

a second auger disposed in the auger chamber, the second auger including a second auger first end disposed proximal to a second side of the tractor body frame and a second auger second end disposed proximal to the second conveyor and to the first auger, the first side of the tractor body frame opposite to the second side of the tractor body frame; and in which the controller is further configured to:

cause the transporting of material on the second conveyor to the auger chamber;

stop the second conveyor if a second conveyor fill period has expired;

cause the second auger to move at least a portion of the material received from the second conveyor away from the second conveyor and toward the second auger first end;

stop the second auger if either a second auger run period has expired or the material disposed at the end of the second auger has reached a second auger material height threshold; and when the second auger material height threshold has been reached, cause the second conveyor to transport additional material to the auger chamber for the second conveyor fill period and then stop the second conveyor.

19. The machine of claim 18, in which the controller is further configured to stop the second conveyor if a second conveyor fill height threshold has been reached.

20. The machine of claim 16, wherein the first and second augers are configured to move material in opposite directions.

* * * * *